US009016933B2

(12) United States Patent
Cettour-Baron et al.

(10) Patent No.: US 9,016,933 B2
(45) Date of Patent: Apr. 28, 2015

(54) BALANCE WHEEL ASSEMBLY WITH OPTIMIZED PIVOTING

(75) Inventors: Raphael Cettour-Baron, Messery (FR); Denis Rudaz, Segny (FR)

(73) Assignee: Rolex S.A., Geneva (CH)

( * ) Notice: Subject to any disclaimer, the term of this patent is extended or adjusted under 35 U.S.C. 154(b) by 102 days.

(21) Appl. No.: 13/556,699

(22) Filed: Jul. 24, 2012

(65) Prior Publication Data

US 2013/0028056 A1 Jan. 31, 2013

(30) Foreign Application Priority Data

Jul. 29, 2011 (EP) ..... 11405295

(51) Int. Cl.
*G04B 17/00* (2006.01)
*G04B 17/06* (2006.01)

(52) U.S. Cl.
CPC ..... *G04B 17/063* (2013.01)

(58) Field of Classification Search
USPC ..... 368/168–178, 322–323
See application file for complete search history.

(56) References Cited

U.S. PATENT DOCUMENTS

| | | | | |
|---|---|---|---|---|
| 1,232,285 | A * | 7/1917 | Greeley | 368/132 |
| 2,654,990 | A | 10/1953 | Le Van | |
| 3,186,157 | A * | 6/1965 | Favret et al. | 368/175 |
| 3,528,237 | A * | 9/1970 | Suard | 368/175 |
| 3,626,691 | A | 12/1971 | Bonsack | |
| 2007/0201317 | A1 | 8/2007 | Houlon | |
| 2010/0002548 | A1 | 1/2010 | Hessler et al. | |
| 2010/0157743 | A1 | 6/2010 | Silva | |
| 2011/0164478 | A1 | 7/2011 | Conus et al. | |

FOREIGN PATENT DOCUMENTS

| | | | |
|---|---|---|---|
| CH | 239786 | A | 11/1945 |
| DE | 1943197 | A1 | 4/1970 |
| EP | 1986059 | A1 | 10/2008 |
| EP | 2141555 | A1 | 1/2010 |
| WO | 2006/045824 | A2 | 5/2006 |

OTHER PUBLICATIONS

European Search Report (ESR) dated Feb. 10, 2012, issued in corresponding European Patent Application No. 11405295; with partial English translation.

Chopard, Pierre, "Incidence de la géométrie du balancier sur les performances chronométriques de la montre (Incidence of balance wheel geometry on chronometric performance of wrist watches)", International Chronometry Symposium, 1969 (15 pages); with English summary on p. 2; with English translation.

Traité de construction horlogére (Watch making treatise), Presses Polytechnique et Universitaire Romandes, p. 662, 2011 (2 pages); with partial English machine-translation.

* cited by examiner

*Primary Examiner* — Sean Kayes

(74) *Attorney, Agent, or Firm* — Westerman, Hattori, Daniels & Adrian, LLP

(57) ABSTRACT

A balance wheel for timepiece movement, which obeys the following condition: $D^5 \cdot f/I \leq 20 \cdot 10^{-2} m^3 kg^{-1} s^{-1}$
where D is the diameter of the balance wheel, f is the frequency and I is the moment of inertia.

20 Claims, 3 Drawing Sheets

BALANCE WHEEL ASSEMBLY WITH OPTIMIZED PIVOTING

The present invention relates to a balance wheel for timepiece movement, to an oscillator for timepiece movement and to an assembly formed by such a balance wheel and its pivoting arrangement. Finally, it relates also to a timepiece movement or to a wrist watch as such equipped with such a balance wheel and with such an assembly.

PRIOR ART

In a mechanical timepiece movement, the balance staff comprises at its ends pivots which rotate in bearings. Existing solutions seek to minimize the friction between a pivot and the bearing in order to limit the energy losses occasioned as the relevant staff rotates.

FIGS. 1 and 2 are schematic depictions of the pivoting of a timepiece movement balance staff using a standard solution of the prior art. A pivot 2, located at the end of a staff 1, has a surface 3 that is rounded at its end. This pivot 2 engages with a bearing comprising a flat jewel known as the endstone 13 and a jewel that has an olived hole, known as the olived jewel 12.

FIG. 1 depicts a first configuration in which the timepiece movement is in a horizontal position (relative to the ground), often referred to as a "flat" position, and in which the balance staff is in a vertical position such that the surface 3 of the pivot 2 bears against the endstone 13. In this first configuration, the surface area for friction between the pivot 2 and the bearing is small and the resulting friction is low.

FIG. 2 depicts a second configuration in which the timepiece movement is in a vertical position, often referred to as a "hanging" position, and in which the balance staff 1 is in a horizontal position. In this configuration, the pivot 2 bears against the edge 14 of the hole in the olived jewel 12, and the resultant friction becomes higher than it was in the first configuration explained hereinabove. The amplitude of oscillation of the spring-balance wheel assembly (sprung balance) is therefore reduced by comparison with the first configuration.

Numerous solutions of the prior art seek to reduce the difference in pivoting behavior described hereinabove between the "flat" and the "hanging" positions, this difference often simply being termed the "flat-hanging difference". This is because it is important to guarantee that a wrist watch will operate independently of its orientation, which varies randomly and unpredictably over time with the movements of the arm of the wearer of the wrist watch. For that reason, existing solutions seek to harmonize the friction there is between a pivot and a bearing in the two main, horizontal and vertical, orientations of a timepiece movement in order to reduce this "flat-hanging difference". By way of example, documents CH239786, US2654990 or even EP1986059 describe such solutions.

Furthermore, it is also accepted, as explained for example in the 1969 publication by Pierre Chopard, entitled "Influence de la géométrie du balancier sur les performances chronometriques de la montre" [Influence of balance wheel geometry on chronometric performance of wrist watches]" published in the proceedings of the International Chronometry Symposium, that large-diameter low-mass balance wheels exhibit the best performance for a given moment of inertia.

However, all the existing solutions are still unsatisfactory and there is a need to improve the behavior of the pivoting of a balance wheel of a timepiece movement.

Thus, the object of the invention is to seek a solution for the pivoting of a timepiece movement balance wheel that reduces the "flat-hanging difference", while at the same time optimizing the energy losses and overall performance of the balance wheel.

BRIEF DESCRIPTION OF THE INVENTION

To this end, the invention relies on a balance wheel or an oscillator for timepiece movement, which obeys the following condition:

$$D^5 \cdot f/I \leq 20 \cdot 10^{-2} m^3 kg^{-1} s^{-1}$$

where D is the diameter of the balance wheel, f is the frequency and I is the moment of inertia.

The invention is defined in detail by the claims.

BRIEF DESCRIPTION OF THE FIGURES

These objects, features and advantages of the present invention will be explained in detail in the following description of some particular embodiments given by way of non-limiting illustration in relation to the attached figures among which.

For the sake of simplicity, in the remainder of the description the same references will be used in the various figures to denote the same elements even if their shapes and properties vary according to the embodiment.

Figure 1:
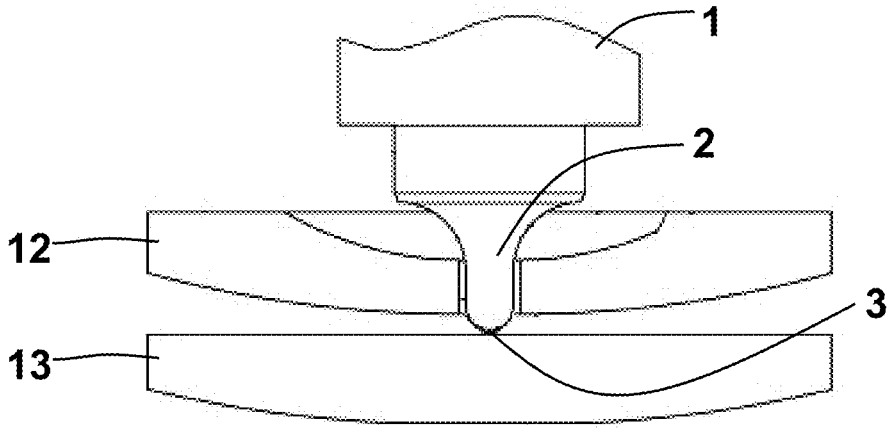
FIG. 1 is a view of an arrangement for the pivoting of a balance wheel according to one state of the art in the horizontal or "flat" position.

The invention relies first of all on the use of a balance wheel which is characterized by a small diameter and/or by a high moment of inertia, i.e. on a balance wheel which is heavy in comparison with those customarily used.

Such a choice thus goes against the preconceived ideas which hold that a balance wheel works better if, on the other hand, it is lightweight and of large diameter.

This characterization of a timepiece movement balance wheel is qualified by the factor $D^5 \cdot f/I$, which is expressed in the units of $10^{-2}\ m^3 kg^{-1} s^{-1}$, where D is the diameter of the balance wheel in meters, f is the frequency of the balance wheel-spiral assembly (or sprung balance) in Hz, and I its moment of inertia in $10^{-10}\ kg \cdot m^2$.

Note that the diameter D of the balance wheel is more specifically that of the external periphery of the felloe or rim of the balance wheel. If this rim has protrusions, such as adjusting screws for example, the diameter to be considered will be an equivalent external diameter obtained by considering an imaginary balance wheel with the same moment of inertia but without the protrusions on the rim and which generates the same aerodynamic friction.

It is accepted in the prior art that a balance wheel has to obey the condition $D^5 \cdot f/I > 20 \cdot 10^{-2}\ m^3 kg^{-1} s^{-1}$, or even $> 30 \cdot 10^{-2}\ m^3 kg^{-1} s^{-1}$. For example, the book entitled "Construction horlogere [Watch making]" (PPUR, 2011) quotes the example of a balance wheel with $I = 10 \cdot 10^{-10}\ kg \cdot m^2$, D=9.5 mm and f=4 Hz, namely $D^5 \cdot f/I - 31.0\ 10^{-2}\ m^3 kg^{-1} s^{-1}$.

By contrast, the embodiment of the invention relies upon a balance wheel or oscillator which obeys the condition $D^5 \cdot f/I \leq 20 \cdot 10^{-2}\ m^3 kg^{-1} s^{-1}$.

It has even been found that highly advantageous solutions are obtained by choosing $D^5 \cdot f/I \leq 16$, even $D^5 \cdot f/I \leq 13$, or even $D^5 \cdot f/I \leq I \leq 10$ or even $D^5 \cdot f/I \leq 8$, these $D^5 \cdot f/I$ factor values being expressed in $10^{-2}\ m^3 kg^{-1} s^{-1}$.

By way of example, the following table gives a number of possible values for a balance wheel according to the invention.

| Inertia $[10^{-10}\ kg \cdot m^2]$ | Diameter [mm] | Frequency [Hz] | $D^5 \cdot f/I$ $[10^{-2}\ m^3 kg^{-1} s^{-1}]$ |
|---|---|---|---|
| 40.7 | 9.89 | 3 | 7 |
| 12 | 8.6 | 4 | 15.7 |
| 14 | 8.6 | 4 | 13.4 |
| 16.2 | 7.78 | 4 | 7 |
| 12.1 | 7.36 | 4 | 7.1 |
| 7.1 | 6.53 | 4 | 6.7 |
| 1.7 | 4.3 | 10 | 8.6 |
| 7.3 | 5.62 | 10 | 7.7 |

More generally, the balance wheel may have a diameter of between 7 and 10 mm and a moment of inertia greater than or equal to $12 \cdot 10^{-10}\ kg \cdot m^2$ when it is intended to be fitted to a timepiece movement of a diameter greater than 20 mm and operating at a spring-balance wheel frequency of oscillation of 4 Hz. Such a balance wheel will be particularly well suited to a movement of high regulating power and will make it possible to achieve good chronometric performance.

As an alternative, the balance wheel may have a diameter less than or equal to 7 mm, particularly for a balance wheel with a moment of inertia less than $10 \cdot 10^{-10}\ kg \cdot m^2$ intended to be fitted to a timepiece movement of a diameter less than 20 mm and operating at a spring-balance wheel frequency of oscillation of 4 Hz, or even for a balance wheel with a moment of inertia less than $10 \cdot 10^{-10}\ kg \cdot m^2$ intended to be fitted to a timepiece movement operating at a spring-balance wheel frequency of oscillation of 10 Hz.

Indeed it has been demonstrated that the use of such a heavy and/or small diameter balance wheel unexpectedly makes it possible to minimize the degradation in the amplitude of the balance wheel in the horizontal (flat) position of a timepiece movement, notably in all the pivoting arrangements that use a particular geometry of the pivot and/or of the bearing in order to obtain relative friction in the horizontal position which is fairly well harmonized with the friction obtained in its vertical (hanging) position.

Thus it has become apparent that the particular combination of a heavy and/or small-diameter balance wheel as defined hereinabove, with a particular geometry between its pivot and a bearing in order to obtain relative friction in the horizontal position that is fairly well harmonized with the friction obtained in the vertical (hanging) position, forms an arrangement that is particularly beneficial because it makes it possible to obtain a timepiece movement with a greatly reduced flat-hanging difference, without however excessively degrading the amplitude of the balance wheel as a result of this particular geometry.

FIGS. 3 to 9 thus illustrate particular geometries which are advantageously combined with the balance wheel described hereinabove, according to various embodiments of the invention.

Figure 3:
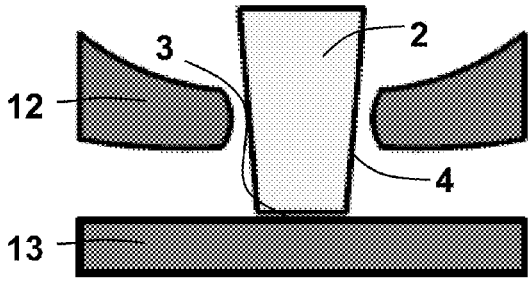
FIGS. 3 to 9 are schematic depictions of arrangements for the pivoting of a balance wheel which are used according to various embodiments of the present invention.

FIG. 3 thus depicts a first embodiment in which the surface 3 at the end of the pivot 2 is flat and bears against a flat endstone 13 in the horizontal position.

Figure 4:
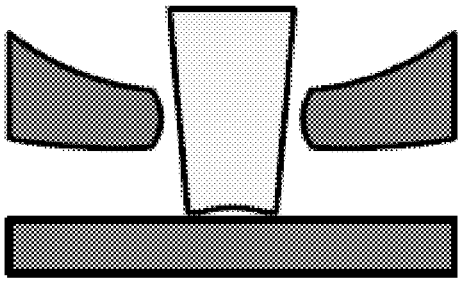

FIG. 4 depicts a second embodiment in which the surface 3 at the end of the pivot 2 is hollow, of substantially hemispherical concave shape, and bears at its periphery against a flat endstone 13 in the horizontal position.

Figure 5:
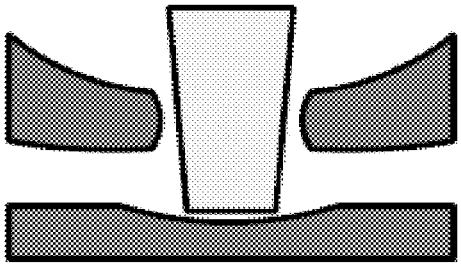

FIG. 5 depicts a third embodiment in which the surface 3 at the end of the pivot 2 is flat and bears against a hemispherical cup of the endstone 13 in the horizontal position.

Figure 6:
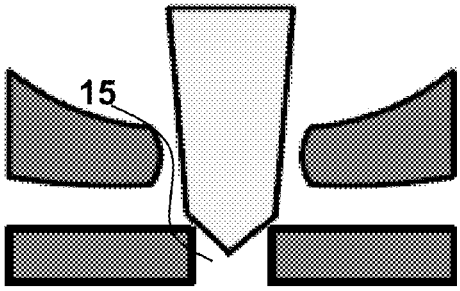

FIG. 6 depicts a fourth embodiment in which the end of the pivot 2 is conical and bears against a hole 15 in the endstone 13 in the horizontal position. The diameter of the hole 15 in the endstone 13 is smaller than the diameter of the base of the pivot cone so that the pivot rests against the edges of the hole 15 in the endstone 13, defining a well controlled region of linear contact. With this embodiment, it is possible to define with precision the friction region and the horizontal quality factor by altering the diameter of the hole.

Figure 7:
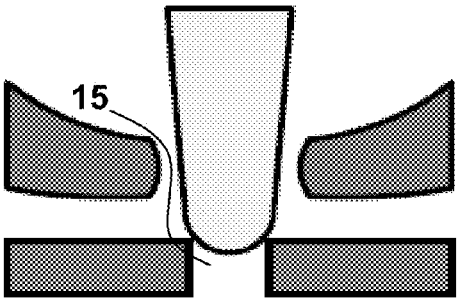

FIG. 7 depicts a fifth embodiment in which the surface 3 at the end of the pivot 2 is rounded, substantially hemispherical, and bears against a hole 15 in the endstone 13 in the horizontal position.

Figure 8:
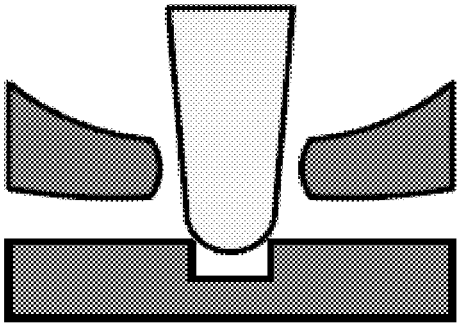

FIG. 8 depicts a sixth embodiment, similar to the previous one, in which the surface 3 at the end of the pivot 2 is rounded and bears against a blind hole 15 in the endstone 13 in the horizontal position.

Figure 9:
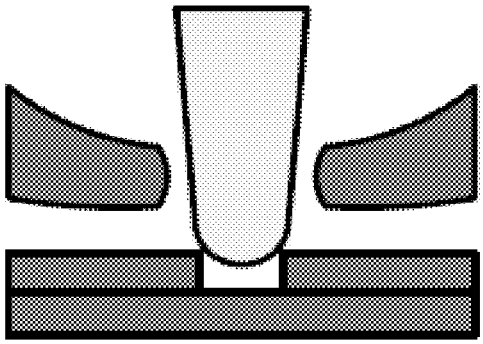

FIG. 9 depicts a seventh embodiment, which is an alternative form of the previous one, in which the surface 3 at the end of the pivot 2 is rounded and bears against a blind hole 15 in the endstone 13 in the horizontal position, this endstone 13 being formed of two separate parts.

In all the solutions that use an endstone 13 comprising a hole 15, the diameter of the hole is chosen so that the pivot does not become jammed in the hole. In addition, the staff engaging with the endstone may be of rounded, hemispherical or conical shape, it being possible for this shape to be adapted to suit the shape of the hole in the endstone.

In all the solutions set forth, the portion 4 of the staff 1 which engages with the olived jewel 12, notably when the wrist watch is in a vertical position, may be of cylindrical or conical cross section.

Naturally, the invention is not restricted to the geometries described and it might be possible for example to choose an endstone with a hole of which the cross section in a plane perpendicular to the bearing surface of the endstone was triangular or trapezoidal, and/or of which the cross section in a plane parallel to the bearing surface of the endstone was circular or polygonal. Furthermore, other embodiments may simply be obtained simply by combining the embodiments described hereinabove.

Figure 2:
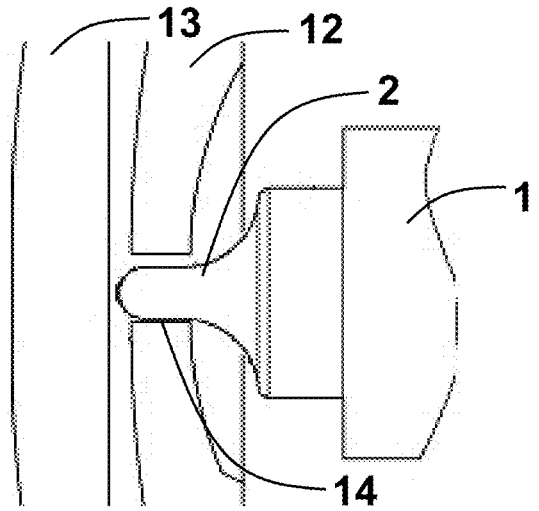
FIG. 2 is a view of an arrangement for the pivoting of a balance wheel according to the state of the art in the vertical or "hanging" position.
Figure 10:
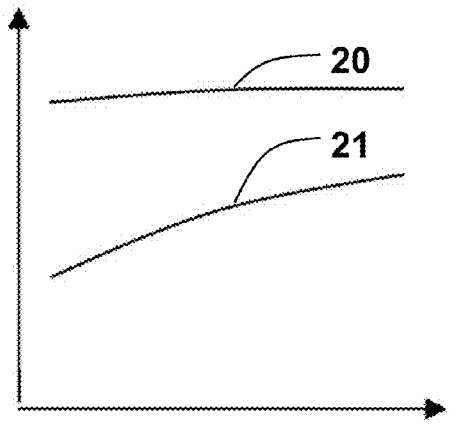
FIGS. 10 and 11 illustrate the quality factors as a function of amplitude which are obtained respectively with a standard balance wheel-pivot assembly and with a balance wheel-pivot assembly according to the invention.
Figure 11:
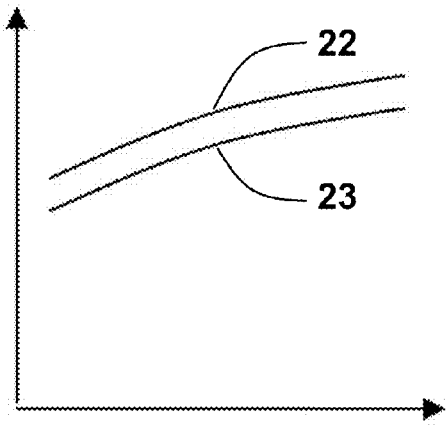

FIGS. 10 and 11 represent the quality factors as a function of amplitude which are obtained respectively with a balance wheel and pivoting arrangement that is standard, as described in FIGS. 1 and 2, and with a balance wheel combined with a pivot device according to one embodiment of the invention.

Curve 20 in FIG. 10 shows the quality factor as a function of amplitude when the timepiece movement is in the horizontal position, and curve 21 shows the quality factor for the vertical position. It may be seen that the quality factor for the horizontal position remains relatively constant whereas the quality factor for the vertical position is markedly lower and decreases rapidly with amplitude.

Curve 22 in FIG. 11 shows the quality factor as a function of amplitude for the horizontal position and curve 23 the quality factor for the vertical position, in the case of a timepiece movement according to one embodiment of the invention. Surprisingly, the flat-hanging difference is greatly reduced, as illustrated by the closeness of the two curves 22, 23 throughout the amplitude range. This reduction in the flat-hanging difference is all the more pronounced when the parameter $D^5 \cdot f/I$ that characterizes the balance wheel is small, particularly for the condition $D^5 \cdot f/I \leq 20 \cdot 10^{-2}\ m^3 kg^{-1} s^{-1}$, more advantageously for $D^5 \cdot f/I \leq 16$, even $D^5 \cdot f/I \leq 13$, or even $D^5 \cdot f/I \leq 10$ or even $D^5 \cdot f/I \leq 8$. That implies that use of a heavy and small-diameter balance wheel becomes highly advantageous, which goes against existing preconceptions.

Measurements have been made on a movement with a balance wheel represented by a parameter $D^5 \cdot f/I = 16$ and a modified pivot arrangement in accordance with FIG. 5, fitted with a standard spring yielding a regulator rated at 4 Hz. The measured flat-hanging amplitude, i.e. the difference in amplitude between the horizontal position and the vertical position, was 10.3±4.5° averaged over ten movements with a loaded barrel. For comparison, the typical flat-hanging difference for a standard solution of the state of the art ($D^5 \cdot f/I = 25$, standard pivoting in accordance with FIG. 1, same spring as for the above measurements) is typically 40°. Advantageously, the geometry of the balance staff pivot and/or of the bearing is therefore suited to ensuring that the relative friction between the pivot and the bearing when the timepiece movement is in the horizontal position is similar to that obtained between the pivot and the bearing in the vertical position, resulting in a difference in amplitude between the horizontal and vertical positions that is preferably less than or equal to 20°, less than or equal to 15°, or even less than or equal to 10°. This makes it possible to obtain a discrepancy in running in the context of the invention that is markedly smaller than that obtained using the standard solution.

The invention claimed is:

1. A balance wheel-spiral assembly for timepiece movement, which obeys the following condition: $D^5 \cdot f/I \leq 20 \cdot 10^{-2} m^3 kg^{-1} s^{-1}$ where D is the diameter of the balance wheel, f is the frequency of the balance wheel-spiral assembly, and I is the moment of inertia of the balance wheel.

2. The balance wheel-spiral assembly for timepiece movement as claimed in claim 1, wherein the balance wheel factor $D^5 \cdot f/I$, expressed in $10^{-2}\ m^3\ kg^{-1} s^{-1}$, obeys the following relationship:

$$D^5 \cdot f/I < 16.$$

3. The balance wheel-spiral assembly for timepiece movement as claimed in claim 1, which has a diameter of between 7 and 10 mm and a moment of inertia greater than or equal to $12 \cdot 10^{-10}\ kg \cdot m^2$.

4. The balance wheel-spiral assembly for timepiece movement as claimed in claim 1, which has a diameter less than or equal to 7 mm.

5. The balance wheel-spiral assembly for timepiece movement as claimed in claim 1, which has an oscillation to a frequency of about 4 Hz.

6. Oscillator for timepiece movement, which comprises a balance wheel-spiral assembly as claimed in claim 1.

7. A timepiece movement, which comprises a balance wheel-spiral assembly as claimed in claim 1.

8. A wrist watch, which comprises a timepiece movement as claimed in claim 7.

9. An arrangement for the pivoting of a timepiece movement balance wheel, comprising (i) a bearing for the pivoting of a balance wheel, (ii) a balance wheel-spiral assembly as claimed in claim 1 and (iii) a balance staff pivot and/or bearing geometry suitable for ensuring that a relative friction between the pivot and the bearing when said timepiece movement is in a horizontal position is similar to that obtained between the pivot and the bearing when said timepiece movement is in a vertical position.

10. The arrangement for the pivoting of a balance wheel as claimed in claim 9, wherein a surface at an end of the balance staff pivot is flat and bears against a flat surface of an endstone in the horizontal position.

11. The arrangement for the pivoting of a balance wheel as claimed in claim 9, wherein a surface at an end of the pivot is concave and bears against a flat surface of an endstone in the horizontal position.

12. The arrangement for the pivoting of a balance wheel as claimed in claim 9, wherein a surface at an end of the balance staff pivot is flat and bears against a concave cup of an endstone in the horizontal position.

13. The arrangement for the pivoting of a balance wheel as claimed in claim 12, wherein the cup of the endstone is hemispherical.

14. The arrangement for the pivoting of a balance wheel as claimed in claim 9, wherein an end of the pivot bears against a hole in an endstone in the horizontal position.

15. The arrangement for the pivoting of a balance wheel as claimed in claim 14, wherein the end of the pivot is convex rounded, hemispherical or conical.

16. The arrangement for the pivoting of a balance wheel as claimed in claim 14, wherein the hole in the endstone is a blind hole.

17. The arrangement for the pivoting of a balance wheel as claimed in claim 13, wherein the endstone is made as two distinct parts.

18. The arrangement for the pivoting of a balance wheel as claimed in claim 14, wherein the end of the balance staff is convex rounded, hemispherical or conical.

19. The arrangement for the pivoting of a balance wheel as claimed in claim 9, wherein the portion of the balance staff that is in contact with the olived jewel is of cylindrical or conical cross section.

20. A timepiece movement, which comprises an arrangement for the pivoting of a balance wheel as claimed in claim 9.

* * * * *